US005839150A

United States Patent [19]

Miyaoka

[11] Patent Number: 5,839,150

[45] Date of Patent: Nov. 24, 1998

[54] BRUSH

[76] Inventor: Atsushi Miyaoka, 22-15-1010, Oji 1-chome, Kita-ku, Tokyo 114, Japan

[21] Appl. No.: 899,360

[22] Filed: Jul. 23, 1997

[51] Int. Cl.[6] ..... A47L 13/10

[52] U.S. Cl. ..... 15/209.1; 15/104.165; 15/210.1

[58] Field of Search ..... 15/206, 211, 209.1, 15/104.165, 210.1

[56] References Cited

U.S. PATENT DOCUMENTS

| | | | |
|---|---|---|---|
| 1,195,190 | 8/1916 | Dunlap | 15/210.1 |
| 2,304,281 | 12/1942 | Riley | 15/206 |
| 2,851,715 | 9/1958 | Goodloe | 15/209.1 |

FOREIGN PATENT DOCUMENTS

| | | | |
|---|---|---|---|
| 52-43968 | 3/1977 | Japan . | |
| 63-92319 | 4/1988 | Japan . | |
| 0025668 | of 1913 | United Kingdom | 15/210.1 |
| 306713 | 2/1929 | United Kingdom | 15/211 |

*Primary Examiner*—Randall E. Chin
*Attorney, Agent, or Firm*—Christie, Parker & Hale, LLP

[57] ABSTRACT

A brush made by twisting a plurality of core elements and tightly holding elongated cloth pieces in gaps between the twisted core elements. In each of the gaps, a plurality of stacked elongated cloth pieces are held together. The elongated cloth pieces are made from a fabric woven with ultra-fine fibers to make loops, or from a moquette fabric of ultra-fine fibers whose tips are raised. The brush can be used either as a washing tool or as a painting tool which is adaptive to surfaces of all types of articles, including hard articles and delicate and soft articles, and performs an excellent washing or painting effect.

2 Claims, 5 Drawing Sheets

PRIOR ART

BRUSH

BACKGROUND OF THE INVENTION

This invention relates to a brush using a core made by twisting metal wires, for example, and tightly holding brush elements in gaps between the twisted wires, for use in washing and painting, for example.

There are known brushes in which a plurality of core elements, such as metal wires, are twisted, and brush elements are tightly held in gaps between the twisted core elements, and these brushes are used for painting, washing and other purposes. In some brushes of this type, used as brush elements are string like stiff pieces such as animal bristles or plastic strings, as shown in FIG. 8. Some other brushes use foamed plastic elements as shown in FIG. 9.

In brushes using string like stiff pieces as their brush elements, as shown in FIG. 8, the brush elements act on an article to be washed by point contact or line contact, and therefore fail to perform sufficient washing effects and often make scratches on the surface to be washed or painted. Additionally, these brushes have low liquid impregnating capacities and cannot hold or contain a sufficient amount of detergent or paint. This is another reason of insufficient washing effects of these brushes, and, in painting, these brushes cannot prevent paint dripping or brush markings on painted surfaces.

In brushes using foamed elements as their brush elements, foamed elements act on an article to be washed by surface contact and perform better washing effects than those of brushes using string like brush elements. However, their effective washing or painting areas are limited to the outer circumferential surfaces of the brush portions, that is, the effective washing or painting areas are too small to ensure acceptable working efficiency and to wipe out dirt or smears into their interior pores or voids. Therefore, the brushes themselves must be cleaned frequently to prevent that dirt or smears on surfaces of the brush elements from re-adhering to the surface be washed.

SUMMARY OF THE INVENTION

It is therefore an object of the present invention to provide a brush which does not make scratches on a surface to be washed painted.

It is another object of the invention is to provide a brush that can contain and hold a large amount of detergent or paint, and promises an improved washing effect.

It is another object of the invention is to provide a brush that greatly decreases paint dripping or brush markings in painting, and has an excellent wiping effect in washing.

It is another object of the invention is to provide a brush that can be manufactured easily.

According to one embodiment of the invention, there is provided a brush using a plurality of twisted core elements and brush elements tightly held in gaps between the twisted core elements, which is particularly characterized in the use of elongated cloth pieces as the brush elements. The elongated cloth pieces are stacked in a plurality of piles, and some stacked cloth pieces of each pile are tightly twisted in each gap. The elongated cloth pieces have a high liquid impregnating capacity, and can contain and hold a large amount of detergent or paint. Therefore, a user can continue his work efficiently without the need for frequent re-supply of detergent or paint to the brush. Additionally, the elongated cloth pieces have both toughness and softness, and are usable for washing or painting either hard or soft articles.

When the elongated cloth pieces are made from ultra-fine fibers, the dirt-wiping efficiency is particularly high, and re-adhesion of dirt can be prevented.

The elongated cloth pieces may be made from a fabric woven with ultra-fine fibers to make loops on its surface or in form of a moquette fabric with raised fibers on its surface to adapt the brush for use on delicate surfaces likely to be damaged or hard surfaces, respectively.

When the elongated cloth pieces are non-woven fabric of ultra-fine fibers, the cost of the brush can be minimized.

DESCRIPTION OF THE PREFERRED EMBODIMENTS

Explained below are preferred embodiments of the invention.

Figure 1:
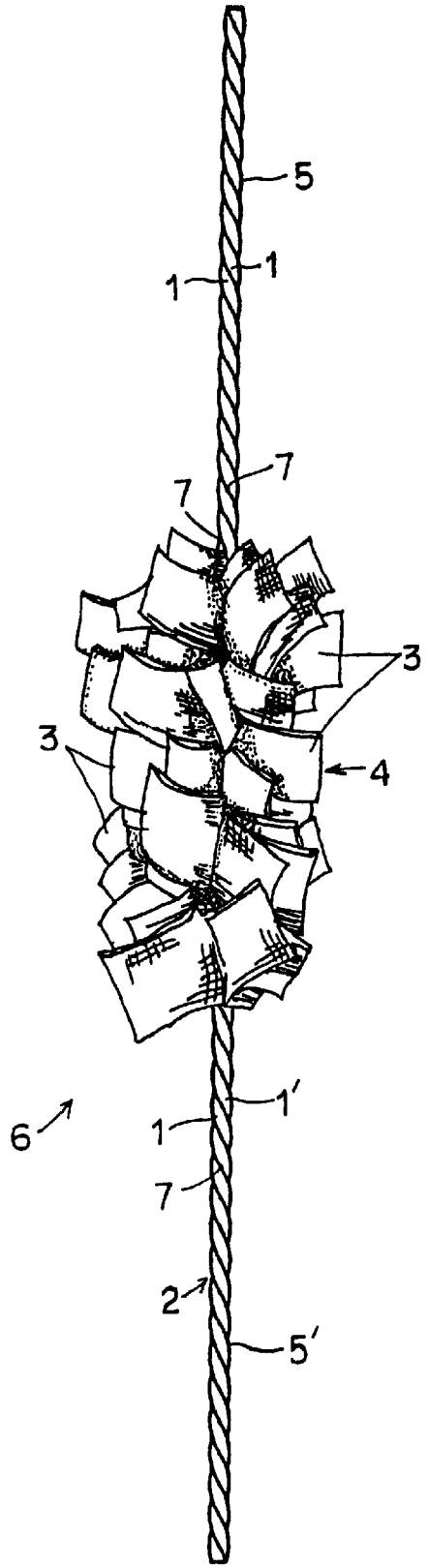
FIG. 1 is a perspective view showing an embodiment of the invention.
Figure 2:
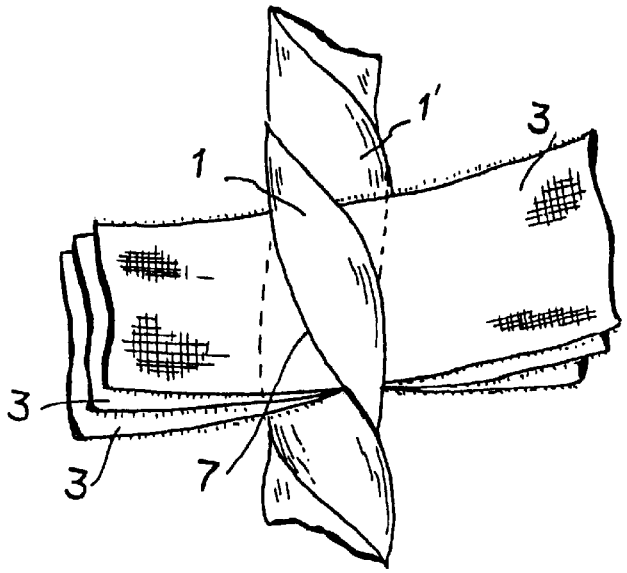
FIG. 2 is a fragmentary perspective view of the embodiment of FIG. 1 in an enlarged scale.

FIGS. 1 through 4 show a first embodiment of the invention. A brush 6 includes a core 2 made by twisting two metal core elements 1, 1' of approximately identical length. The metal core elements have appropriate flexibility and plasticity for such twisting. In a lengthwise central range of the core 2, the core elements 1, 1' tightly hold stacks of elongated cloth pieces 3 in gaps 7 between them such that the stacks of elongated cloth pieces 3 extend radially from the core 2 as best shown in FIG. 2, forming a tuft-like brush portion 4 continuous over a certain length of the core 2. Opposite ends of the core 2 are used as grips 5, 5'.

The elongated cloth pieces 3 are stacked to make a plurality of lots each containing several cloth pieces. Cloth pieces 3 in each lot are tightly held together in one of gaps 7 between the twisted core elements 1, 1', as best shown in FIG. 2, while the core elements 1, 1' are twisted.

Figure 5:
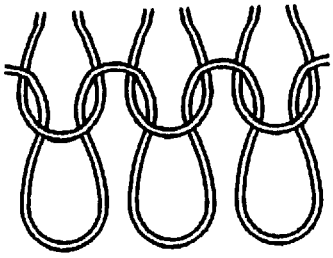
FIG. 5 is a diagram showing details of a fabric usable as brush elements in the same embodiment.
Figure 6:
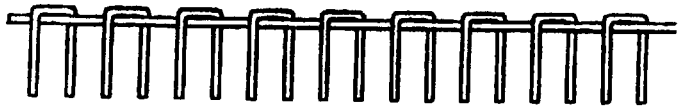
FIG. 6 is a diagram showing details of another fabric usable as brush elements in the same embodiment.

The elongated cloth pieces 3 are preferably made from ultra-fine fibers. The ultra-fine fibers may be ultra-fine yarns of 1 denier (10 $\mu$m in diameter) containing acrylic polymer, polyester, polyamide, or their appropriate combinations, and may be woven to make loops on its surface like a pile fabric as shown in FIG. 5, or as a moquette fabric in which fiber tips are raised straight on its surface as shown in FIG. 6.

Figure 3:
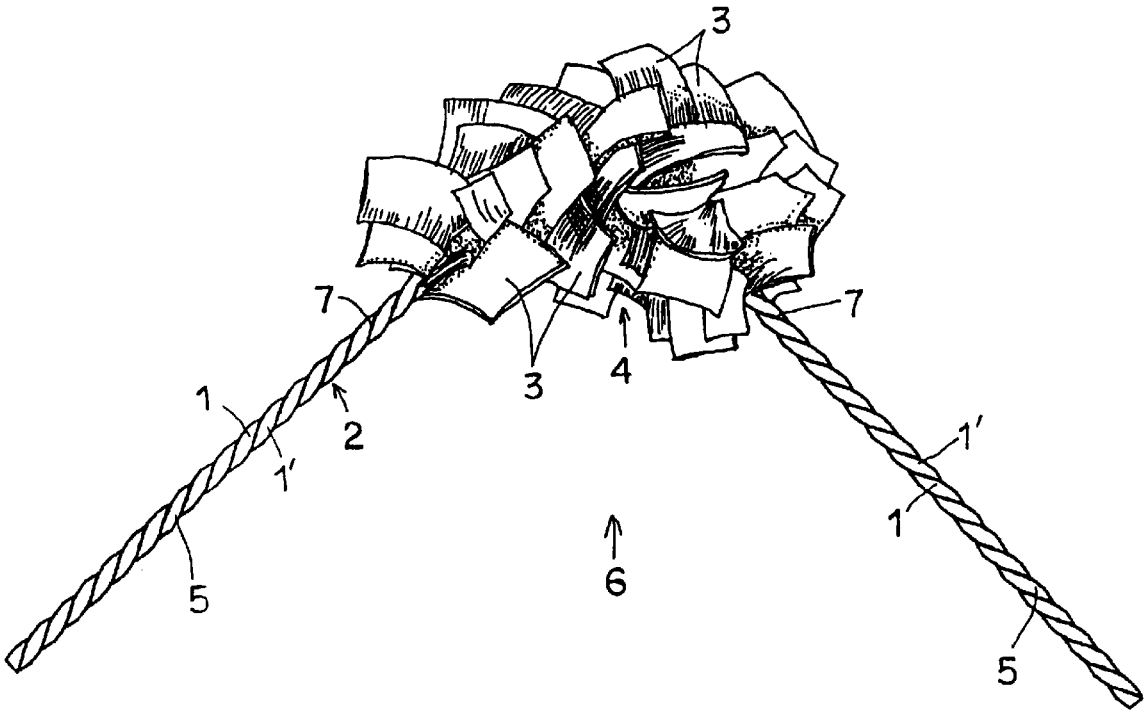
FIG. 3 is a perspective view showing a mode of use of the brush according to the embodiment of FIG. 1.
Figure 4:
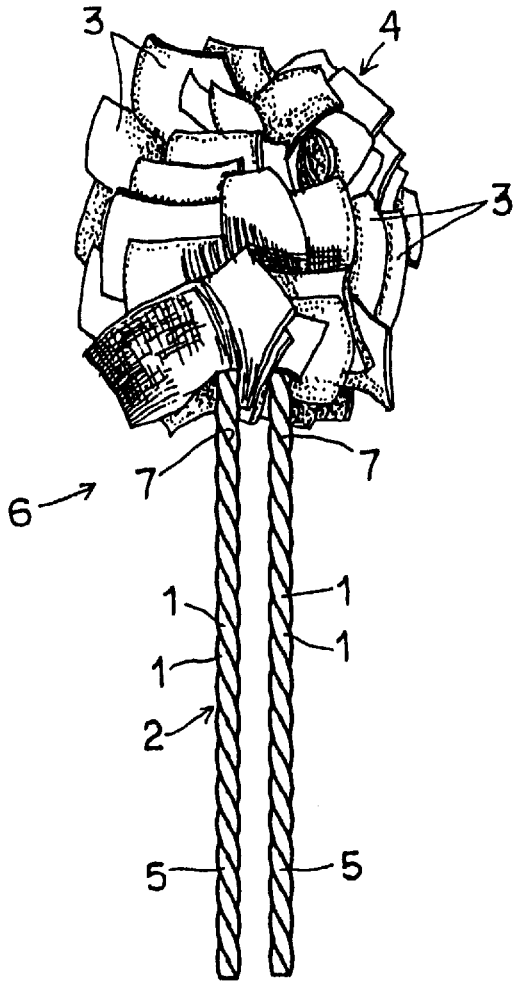
FIG. 4 is a perspective view showing another mode of use of the brush according to the embodiment of FIG. 1.

The brush 6 having the above-explained structure may be used either in a straight-extending form shown in FIG. 1, or in a form as shown in FIG. 3 or FIG. 4, where the brush 6 is bent loosely or tightly from a central point of the brush portion. During use, the brush 6 is gripped at the grips 5, 5', and immersed into detergent for washing or in paint for painting. For example, if the outer circumferential surface of a rod-shaped article is washed, the brush may be loosely bent from its central portion as shown in FIG. 3, and a user may put his hands on the grips 5, 5', respectively. Alternatively, as shown in FIG. 4, the brush 6 may be tightly bent, and a user may grip both grips 5, 5' together with his single hand. There are these and other modes of use of the brush for these and other purposes.

The brush 6 according to the embodiment, with the brush portion 4 being made by tightly holding brush elements in gaps 7 between the twisted core elements 1, 1', can be manufactured very easily, without the need for complicated steps for bonding, sawing or other purposes.

Additionally, the brush portion 4 made of the elongated cloth pieces 3 ensure a wide area of contact with articles to be washed, and can perform a high washing effect. Since the elongated cloth pieces 3 have appropriate stiffness and softness, the brush 6 can be used to various articles of various materials, such as glass, wood, plastic resin, ceramic, metal, and others, to be washed or painted. Further, the water-absorptive property of the cloth also contributes to increasing in the washing effect.

Further, since the brush portion 4 is made by stacking a plurality of elongated cloth pieces 3 together in each gap 7, individual cloth pieces 3 in each stack or lot sequentially act on a portion to be washed, and this also promises a high washing effect. The cloth pieces 3 with a high liquid impregnating property can contain and hold a large amount of detergent or paint. Therefore, the brush 6 improves the speed of jobs, with a sufficient washing effect in washing, or without paint dripping or brush markings in painting.

When the elongated cloth pieces 3 are made from ultra-fine fibers, they closely contact with surfaces to be washed or painted. Additionally, they have a void volume high enough to contain and hold a large amount of detergent or paint. The high void volume also contributes to increase the dirt-wiping effect, and can prevent that dirt or stain from re-adhering to the surface to be washed.

The elongated cloth pieces 3 may be made of a pile fabric as shown in FIG. 5, having loops on their surfaces. Alternatively, they may be made of a moquette fabric with raised fiber tips (in which fiber tips are raised straight) as shown in FIG. 6. When the elongated cloth pieces 3 are made of a fabric having loops, the brush 6 performs a softer wiping effect. Therefore, the brush 6 is suitable for use in washing or painting ceilings or walls which are made of relatively soft materials, such as wood or cloth. When the elongated cloth pieces 3 are made of a moquette fabric, the brush portion has a kind of toughness and performs a strong wiping function. Therefore, the brush 6 of this type is suitable for use in washing or painting surfaces of hard materials, such as metal.

The elongated cloth pieces may be made from nonwoven fabric. Non-woven fabric using ultra-fine fibers is functionally excellent. Moreover, non-woven fabrics are less expensive, and the brush 6 using non-woven fabrics is economical enough for users to use it hard and frequently replace it with new one.

Figure 7:
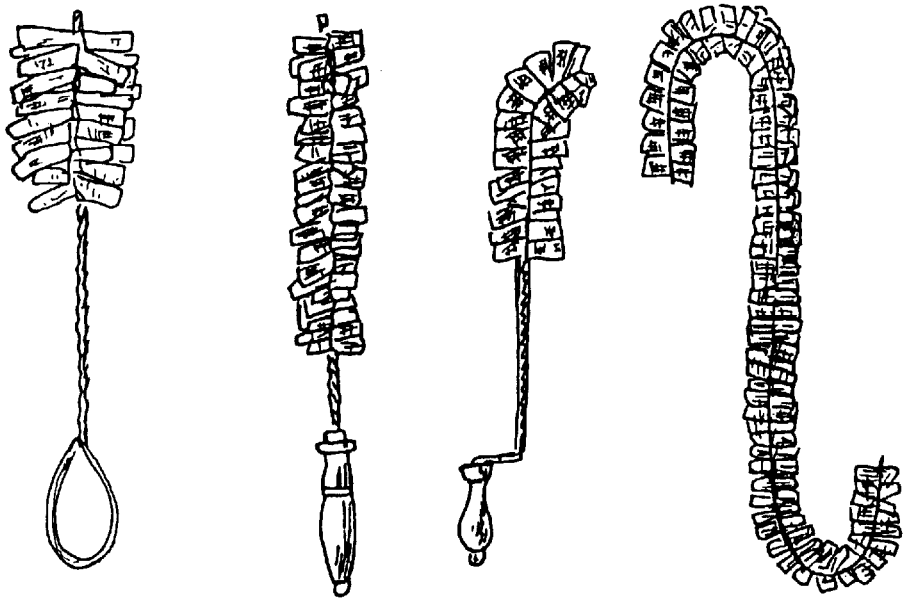
FIG. 7 is a perspective view showing another embodiment of the invention.
Figure 8:
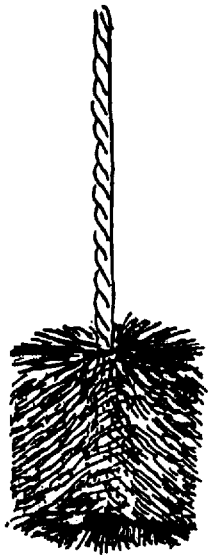
FIG. 8 is a perspective view showing a conventional brush.
Figure 9:
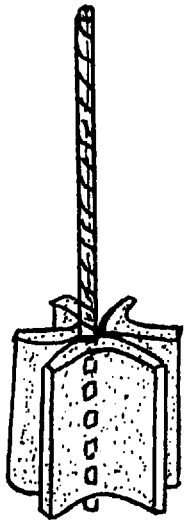
PRIOR ART Fig. 9
FIG. 9 is a perspective view showing another conventional brush.

FIG. 7 shows alternate embodiments of the invention including brushes having various handles and shapes. These brushes can be used and produced in substantially the same manner as explained with the first embodiment.

As described above, the brushes according to the various embodiments of the invention can be used for washing or painting surfaces of various articles. They are suitable for use with liquid detergent to wash surfaces of, in particular, soft articles likely to be damaged, and for use in painting by impregnating them with paint. Additionally, they can be used as tools for dry-mopping or polishing articles.

What is claimed is:

1. A brush comprising:

a plurality of core elements twisted together to form a core; and a plurality of brush elements tightly held in caps between the twisted core elements, each said brush element held in each said gap being a plurality of elongated cloth pieces stacked together, wherein said elongated cloth pieces are made of a fabric of ultra-fine fibers which are woven to make loops.

2. A brush comprising:

a plurality of core elements twisted together to form a core; and a plurality of brush elements tightly held in gaps between the twisted core elements, each said brush element held in each said cap being a plurality of elongated cloth pieces stacked together, wherein said elongated cloth pieces are made of a moquette fabric of ultra-fine fibers, in which fiber tips are raised.

* * * * *

UNITED STATES PATENT AND TRADEMARK OFFICE

CERTIFICATE OF CORRECTION

PATENT NO. : 5,839,150

DATED : November 24, 1998

INVENTOR(S) : Atsushi Miyaoka

It is certified that error appears in the above-identified patent and that said Letters Patent is hereby corrected as shown below:

Title page,
Item [56] References Cited, replace
"0025668 of 1913 United Kingdom...15/210.1" with
-- 0025668 3/1913 United Kingdom...15/210.1 --.

Column 1, line 45, replace "washed painted" with -- washed or painted --.
Column 1, line 46, after "invention" delete "is".
Column 1, line 49, after "invention" delete "is".
Column 1, line 52, after "invention" delete "is".
Column 3, line 18, replace "used to" with -- used on --.
Column 4, line 13, after "with" insert -- a --.

Signed and Sealed this

Tenth Day of October, 2000

*Attest:*

Q. TODD DICKINSON

*Attesting Officer*

*Director of Patents and Trademarks*